United States Patent [19]

Nitu

[11] 3,986,559

[45] Oct. 19, 1976

[54] FIRE ESCAPE DEVICE

[75] Inventor: Jon E. Nitu, College Point, N.Y.

[73] Assignee: The Raymond Lee Organization, Inc., New York, N.Y. ; a part interest

[22] Filed: Aug. 7, 1975

[21] Appl. No.: 602,646

[52] U.S. Cl. ..... 169/48; 160/9

[51] Int. Cl.[2] ..... E05F 15/20

[58] Field of Search ..... 169/48, 49; 160/1, 2, 160/3, 4, 5, 6, 9, 33, 37

[56] References Cited

UNITED STATES PATENTS

| | | | |
|---|---|---|---|
| 881,455 | 3/1908 | Bennerscheidt | 160/1 |
| 1,257,273 | 2/1918 | McCloud | 160/9 |
| 1,369,518 | 2/1921 | Bumbarger | 160/1 |
| 1,708,377 | 4/1929 | Cornell | 160/9 |
| 3,451,163 | 6/1969 | Malissa | 160/1 X |
| 3,687,185 | 8/1972 | Singer | 160/1 |

*Primary Examiner*—Evon C. Blunk
*Assistant Examiner*—Michael Mar
*Attorney, Agent, or Firm*—Daniel Jay Tick

[57] ABSTRACT

A plurality of sections of fireproof material are movably mounted on the ceiling of a room in the area of a window in the room. The sections are shaped to enclose a predetermined area around the window. One of the sections is affixed to the ceiling and the remaining sections are movably mounted in coupled and cooperative relation with the one of the sections and with each other. In stored condition, the sections are in a minimum area in abutment with the ceiling and spaced from the floor. In extended condition, the sections form a continuous partition from ceiling to floor at a predetermined distance from and around the window and abut the wall at a predetermined distance from both sides of the window thereby isolating a predetermined area around the window from fire. A latch device releasably maintains the sections in stored condition and permits the sections to extend to the extended position when the latch device is released.

3 Claims, 8 Drawing Figures

FIG. 1
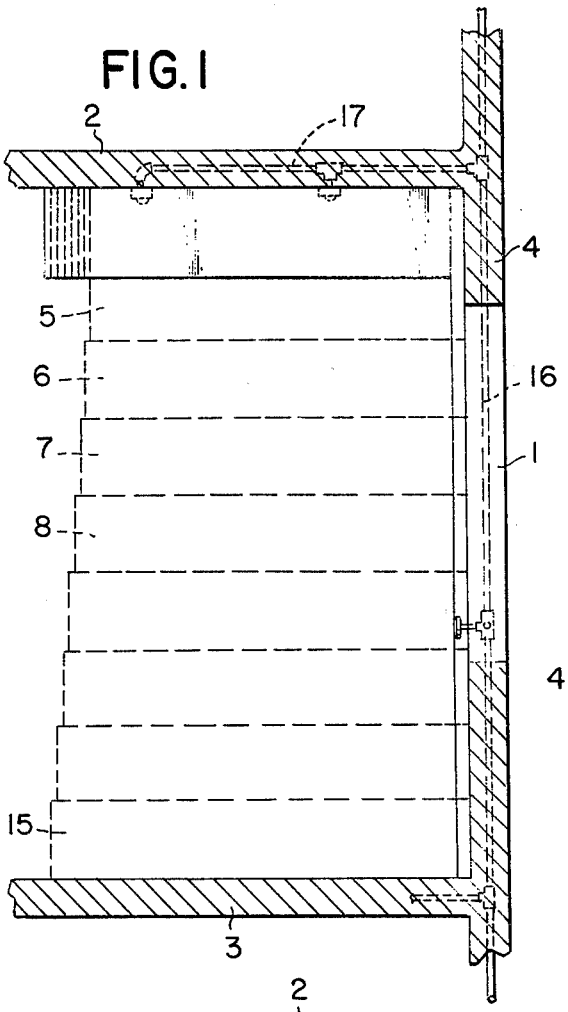
FIG. 2
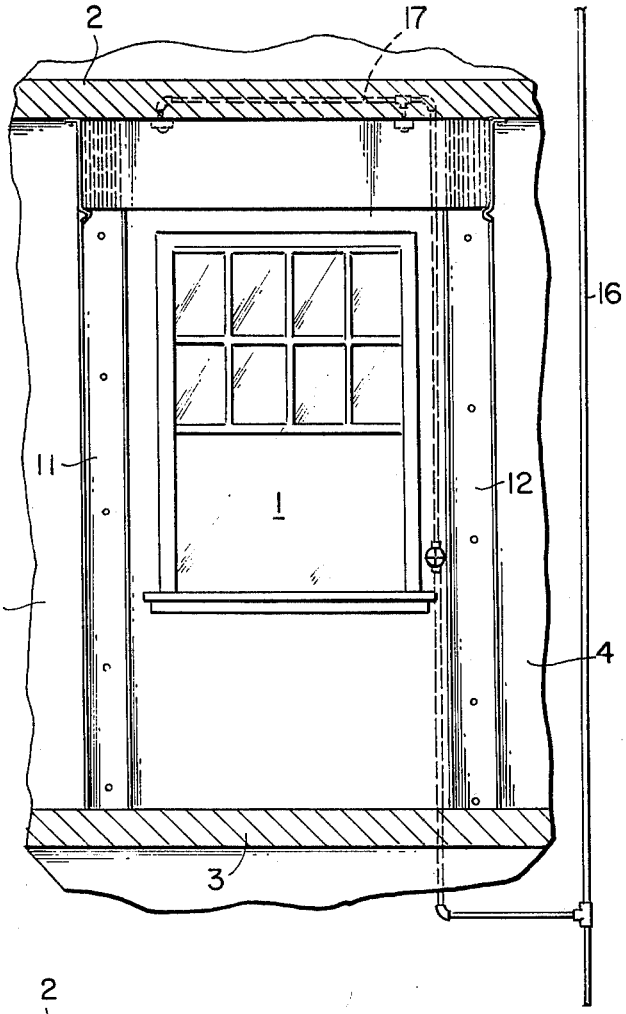
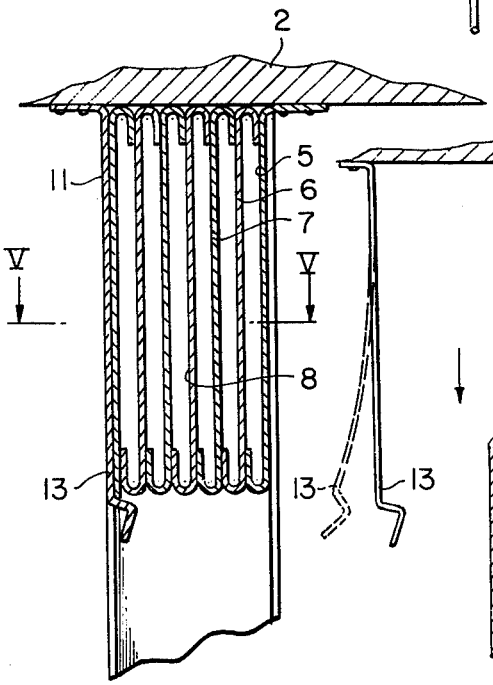
FIG. 3
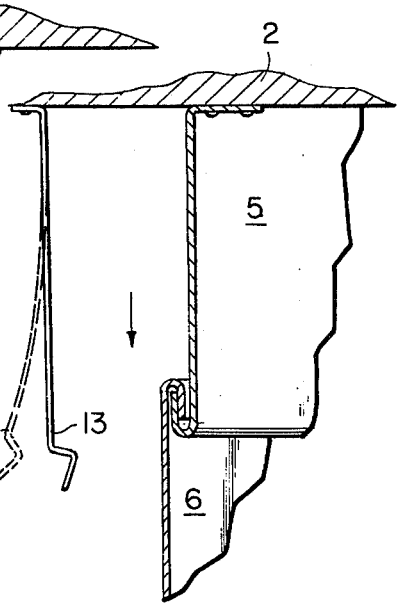
FIG. 4
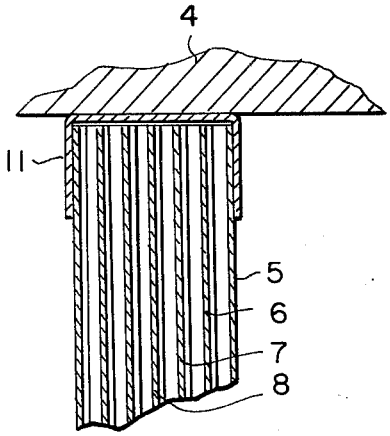
FIG. 5

FIRE ESCAPE DEVICE

DESCRIPTION OF THE INVENTION

The present invention relates to a fire escape device. More particularly, the invention relates to a fire escape device for a room of a structure having a window, ceiling, floor and wall from ceiling to floor around the window in the room.

Objects of the invention are to provide a fire escape device of simple structure, which is inexpensive in manufacture, installed with facility and convenience in new and existing structures and functions efficiently, effectively and reliably to isolate a predetermined area around a window of a room from fire, thereby providing a sanctuary for people trapped in a fire, while awaiting rescue or escape through the window.

In order that the invention may be readily carried into effect, it will now be described with reference to the accompanying drawing, wherein:

FIG. 1 is a side view of an embodiment of the fire escape device of the invention;

FIG. 2 is a front view of the embodiment of FIG. 1;

FIG. 3 is a cross-sectional view on an enlarged scale, of part of the embodiment of FIGS. 1 and 2, illustrating the latching device in closed position;

FIG. 4 is a perspective view of the part of the device shown in FIG. 3 with the latch device in open position;

FIG. 5 is a cross-sectional view, taken along the lines V—V, of FIG. 3;

In the FIGS., the same components are identified by the same reference numerals.

Figure 6:
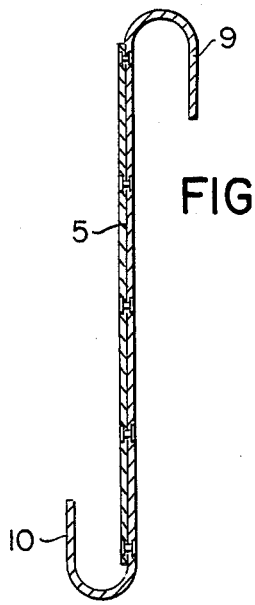
FIG. 6 is a cross-sectional view, on an enlarged scale, of a single section of the embodiment of FIGS. 1 and 2.

The fire escape device of the invention is for a room of a structure having a window 1, a ceiling 2, a floor 3 and a wall 4 from ceiling to floor around the window in the room, as shown in FIGS. 1 and 2. The device is also for a part of a room or a big floor.

The fire escape device of the invention comprises a plurality of sections 5, 6, 7, 8, and so on (FIGS. 1, 3, 5 and 8), of substantially fireproof material of any suitable known type movably mounted on the ceiling 2 of the room in the area of the window 1 in the room. The sections 5, 6, 7, 8, and so on, are shaped to enclose a predetermined area around the window 1. One of the sections such as, for example, the section 5, is affixed to the ceiling and the remaining sections are movably mounted in coupled cooperative relation with the section 5 and with each other. The section 5 is also affixed to the wall 4, so that it provides an anchor for the remaining sections.

The sections 5, 6, 7, 8, and so on, are mounted in coupled and cooperative relation in any suitable manner such as, for example, via curved or hooked ends 9 and 10 (FIG. 6) which are coupled to each other in the extended condition of the sections, as illustrated in FIG. 4. Thus, in stored condition, the sections 5, 6, 7, 8, and so on, are in a minimum area in substantial abutment with the ceiling and spaced from the floor 3, as shown in FIGS. 1, 2, 3, 5, and 8. In extended condition, the sections 5, 6, 7, 8, and so on, form a continuous partition, indicated by broken lines in FIG. 1, from the ceiling 2 to the floor 3 at a predetermined distance from and around the window and abutting the wall 4 at a predetermined distance from both sides of the window thereby isolating a predetermined area around the window from fire.

The sections 5, 6, 7, 8, and so on, are preferably supported in a pair of guide members 11 and 12 (FIGS. 2, 3, 5 and 8), each of substantially U-shaped cross-section and each affixed to the wall 4 and extending substantially vertically between the ceiling 2 and the floor 3 at a predetermined distance from a corresponding side of the window 1.

As shown in FIGS. 3 and 4, a latch device 13 releasably maintains the sections 5, 6, 7, 8, and so on, in stored condition, as shown in FIG. 3, and permits the sections to extend to the extended condition when the latch device is released, as shown in FIG. 4.

Figure 7:
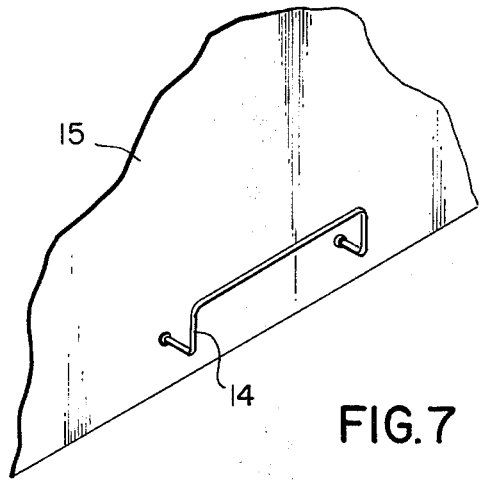
FIG. 7 is a perspective view of an embodiment of the handle of the fire escape device of the invention.
Figure 8:
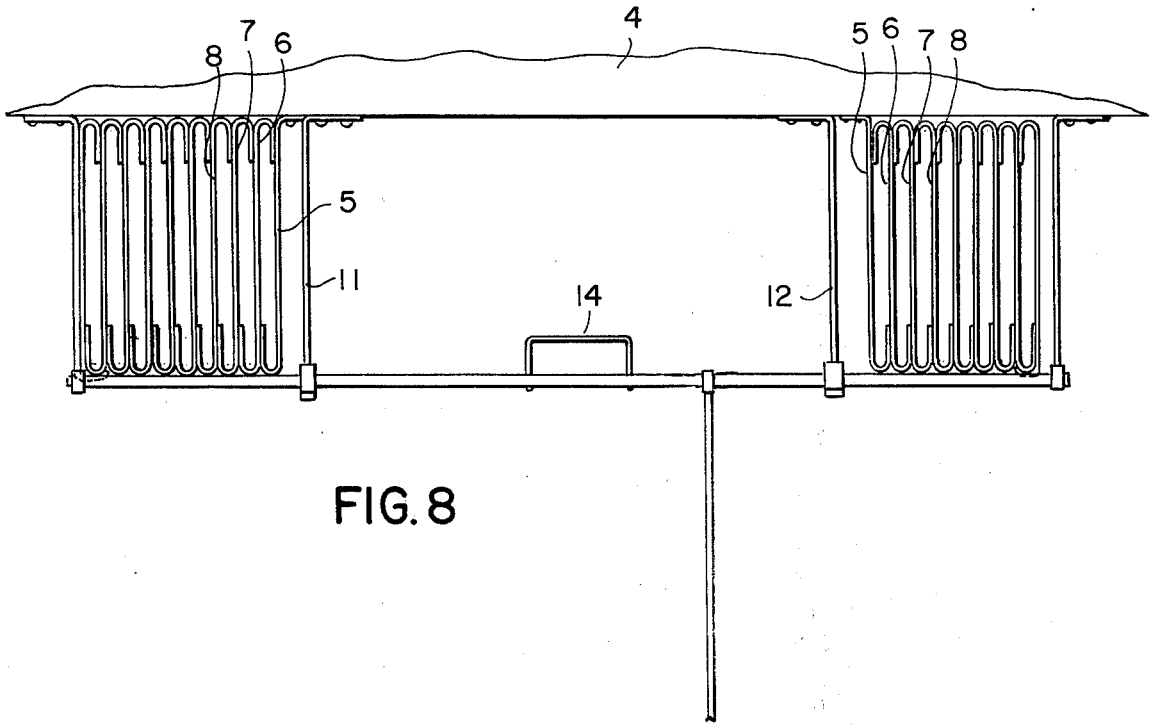
FIG. 8 is a top view of the embodiment of FIGS. 1 and 2.

A handle 14 is affixed to one of the sections 15 (as shown in FIG. 7) which abuts the floor 3 in the extended condition of the sections (FIG. 1) for facilitating raising the one of the sections to permit a person to enter to sanctuary when the sections are in extended condition.

Water pipes such as, for example, pipes 16 and 17 (FIGS. 1 and 2) provide a stream of water in the area of the sections 5, 6, 7, 8, and so on, and 15, and on said sections to keep them from becoming too hot when there is a fire.

The inside of the device of the invention is covered by asbestos to protect people in it from the high temperatures and to avoid the elimination of humidity from the air necessary for breathing.

While the invention has been described by means of a specific example and in a specific embodiment, I do not wish to be limited thereto, for obvious modifications will occur to those skilled in the art without departing from the spirit and scope of the invention.

I claim:

1. A fire escape device for a room of a structure having a window, ceiling, floor and wall from ceiling to floor around the window in the room, said fire escape device comprising a plurality of sections of substantially fireproof material movably mounted on the ceiling of a room in the area of a window in the room, said sections comprising a first section spaced from the window and substantially parallel thereto and two side sections each extending from a corresponding part of the first section to the wall on each side of the window said sections being shaped to enclose a predetermined area around the window, one of the sections being affixed to the ceiling and the remaining sections having curved ends and being movably mounted in coupled and cooperative relation with the one of the sections and with each other via said curved ends in a manner whereby in stored condition the sections are in a minimum area in substantial abutment with the ceiling and spaced from the floor and in extended condition the sections form a continuous partition from ceiling to floor at a predetermined distance from and around the window and abutting the wall at a predetermined distance from both sides of the window thereby isolating a predetermined area around the window from fire; and latch means for releasably maintaining the sections in stored condition and permitting the sections to extend to the extended condition when the latch means is released.

2. A fire escape device as claimed in claim 1, further comprising a handle affixed to one of the sections which abuts the floor in the extended condition of the sections for facilitating raising said one of said sections.

3. A fire escape device as claimed in claim 1, further comprising water means for providing a stream of water in the area of the sections and on the sections.

* * * * *